US011516609B2

(12) United States Patent
Messier et al.

(10) Patent No.: US 11,516,609 B2
(45) Date of Patent: *Nov. 29, 2022

(54) METHODS AND APPARATUS FOR ANALYZING MICROPHONE PLACEMENT FOR WATERMARK AND SIGNATURE RECOVERY

(71) Applicant: The Nielsen Company (US), LLC, New York, NY (US)

(72) Inventors: Marc Messier, Dallas, TX (US); James Joseph Vitt, Palm Harbor, FL (US); Venugopal Srinivasan, Tarpon Springs, FL (US); Alexander Topchy, New Port Richey, FL (US)

(73) Assignee: The Nielsen Company (US), LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/170,472

(22) Filed: Feb. 8, 2021

(65) Prior Publication Data

US 2021/0160638 A1 May 27, 2021

Related U.S. Application Data

(63) Continuation of application No. 16/259,866, filed on Jan. 28, 2019, now Pat. No. 10,917,732, which is a (Continued)

(51) Int. Cl.

| | |
|---|---|
| ***H04R 29/00*** | (2006.01) |
| ***G10L 19/018*** | (2013.01) |

(52) U.S. Cl.

CPC ..... *H04R 29/004* (2013.01); *G10L 19/018* (2013.01); *H04R 2420/07* (2013.01); *H04R 2499/15* (2013.01); *H04S 2400/15* (2013.01)

(58) Field of Classification Search

None

See application file for complete search history.

(56) References Cited

U.S. PATENT DOCUMENTS 5,377,224 A 12/1994 Hudson
6,184,898 B1 * 2/2001 Rice ..... G01R 13/345 345/440

(Continued)

OTHER PUBLICATIONS

Wikipedia, "Sound reinforcement system," retrieved from https://en.wikipedia.org/wiki/Sound_reinforcement_system, last modified on Oct. 18, 2016, 20 pages.

(Continued)

*Primary Examiner* — James K Mooney

(74) *Attorney, Agent, or Firm* — Hanley, Flight & Zimmerman, LLC

(57) ABSTRACT

Methods and apparatus to analyze microphone placement for watermarks and signatures are disclosed. An example instructions cause one or more processors to at least determine a variance of a magnitude spectrum of a frequency band corresponding to a frequency spectrum of a first audio signal sensed with an audio sensor. The example instructions further cause the one or more processors to determine, based on the variance, a recovery rate associated with at least one of watermark detection or signature generation to be performed on a second audio signal to be sensed with the audio sensor.

20 Claims, 4 Drawing Sheets

Related U.S. Application Data continuation of application No. 15/336,348, filed on Oct. 27, 2016, now Pat. No. 10,194,256.

(56) References Cited

U.S. PATENT DOCUMENTS

| | | | |
|---|---|---|---|
| 6,216,266 | B1 | 4/2001 | Eastman et al. |
| 6,484,316 | B1 | 11/2002 | Lindberg |
| 6,732,061 | B1 | 5/2004 | Wichelman et al. |
| 7,130,705 | B2 | 10/2006 | Amir et al. |
| 7,787,328 | B2 | 8/2010 | Chu et al. |
| 7,912,427 | B2 | 3/2011 | Santoru et al. |
| 8,699,721 | B2 | 4/2014 | Burnett |
| 9,305,559 | B2 | 4/2016 | Sharma et al. |
| 10,194,256 | B2 | 1/2019 | Messier et al. |
| 10,917,732 | B2 | 2/2021 | Messier et al. |
| 2006/0253209 | A1 | 11/2006 | Hersbach et al. |
| 2011/0313555 | A1 | 12/2011 | Shoham et al. |
| 2013/0210352 | A1 | 8/2013 | Ling et al. |
| 2014/0058704 | A1 | 2/2014 | Buchanan et al. |
| 2014/0325551 | A1 | 10/2014 | McMillan |
| 2016/0042734 | A1 | 2/2016 | Cetinturk |
| 2016/0140969 | A1 | 5/2016 | Srinivasan et al. |
| 2018/0124533 | A1 | 5/2018 | Messier et al. |
| 2019/0158972 | A1 | 5/2019 | Messier et al. |

OTHER PUBLICATIONS

Boyle, "Spectrum Analysis," HND Sound Production, retrieved from https://michaelboylehndsoundproductionportfolio.wordpress.com/spectrum-analysis/, posted on Jun. 10, 2014, 4 pages.

Rees et al., "The Oxford Handbook of Auditory Science: The Auditory Brain," vol. 2, Oxford University Press, 2010, pp. 307-308, 4 pages.

United States Patent and Trademark Office, "Final Office Action," issued in connection with U.S. Appl. No. 15/336,348, dated Apr. 24, 2018, 6 pages.

United States Patent and Trademark Office, "Non-Final Office Action," issued in connection with U.S. Appl. No. 15/336,348, dated Dec. 1, 2017, 8 pages.

United States Patent and Trademark Office, "Notice of Allowance and Fee(s) Due," issued in connection vith U.S. Appl. No. 15/336,348, dated Sep. 12, 2018, 8 pages.

United States Patent and Trademark Office, "Corrected Notice of Allowability," issued in connection with U.S. Appl. No. 15/336,348, dated Sep. 18, 2018, 4 pages.

United States Patent and Trademark Office, "Non-Final Office Action," issued in connection with U.S. Appl. No. 16/259,866, dated Jun. 16, 2020, 7 pages.

United States Patent and Trademark Office, "Notice of Allowance and Fee(s) Due," issued in connection with U.S. Appl. No. 16/259,866, dated Oct. 2, 2020, 7 pages.

United States Patent and Trademark Office, "Corrected Notice of Allowability," issued in connection with U.S. Appl. No. 16/259,866, dated Oct. 6, 2020, 4 pages.

* cited by examiner

METHODS AND APPARATUS FOR ANALYZING MICROPHONE PLACEMENT FOR WATERMARK AND SIGNATURE RECOVERY

RELATED APPLICATION

This patent arises from a continuation of U.S. patent application Ser. No. 16/259,866, entitled "METHODS AND APPARATUS FOR ANALYZING MICROPHONE PLACEMENT FOR WATERMARK AND SIGNATURE RECOVERY," filed on Jan. 28, 2019, which is a continuation of U.S. patent application Ser. No. 15/336,348, entitled "METHODS AND APPARATUS FOR ANALYZING MICROPHONE PLACEMENT FOR WATERMARK AND SIGNATURE RECOVERY," filed on Oct. 27, 2016. Priority to U.S. patent application Ser. No. 16/259,866 and U.S. patent application Ser. No. 15/336,348 is claimed. U.S. patent application Ser. No. 16/259,866 and U.S. patent application Ser. No. 15/336,348 are incorporated herein by reference in their entirety.

FIELD OF THE DISCLOSURE

This disclosure relates generally to audio signal recovery and, more particularly, to methods and apparatus for analyzing microphone placement for watermark and signature recovery.

BACKGROUND

Media monitoring meters are used in homes and other locations to determine exposure to media (e.g., audio media and/or video media) output by media output devices. Such media output devices include televisions, radios, computers, tablets, and/or any other device capable of outputting media. In some examples, an audio component of the media is encoded with a watermark (e.g., a code) that includes data related to the media. In such examples, when the meter receives the media, the meter extracts the watermark to identify the media. Additionally, the meter transmits the extracted watermark to an audience measurement entity to monitor media exposure. In some examples, the meter generates a signature or fingerprint of the media based on the characteristics of the audio component of the media. In such examples, the meter transmits the signature to the audience measurement entity. The audience measurement entity compares the generated signature to stored reference signatures in a database to identify a match, thereby identifying the media. The audience measurement entity monitors media exposure based on a match between the generated signature and a reference signature.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
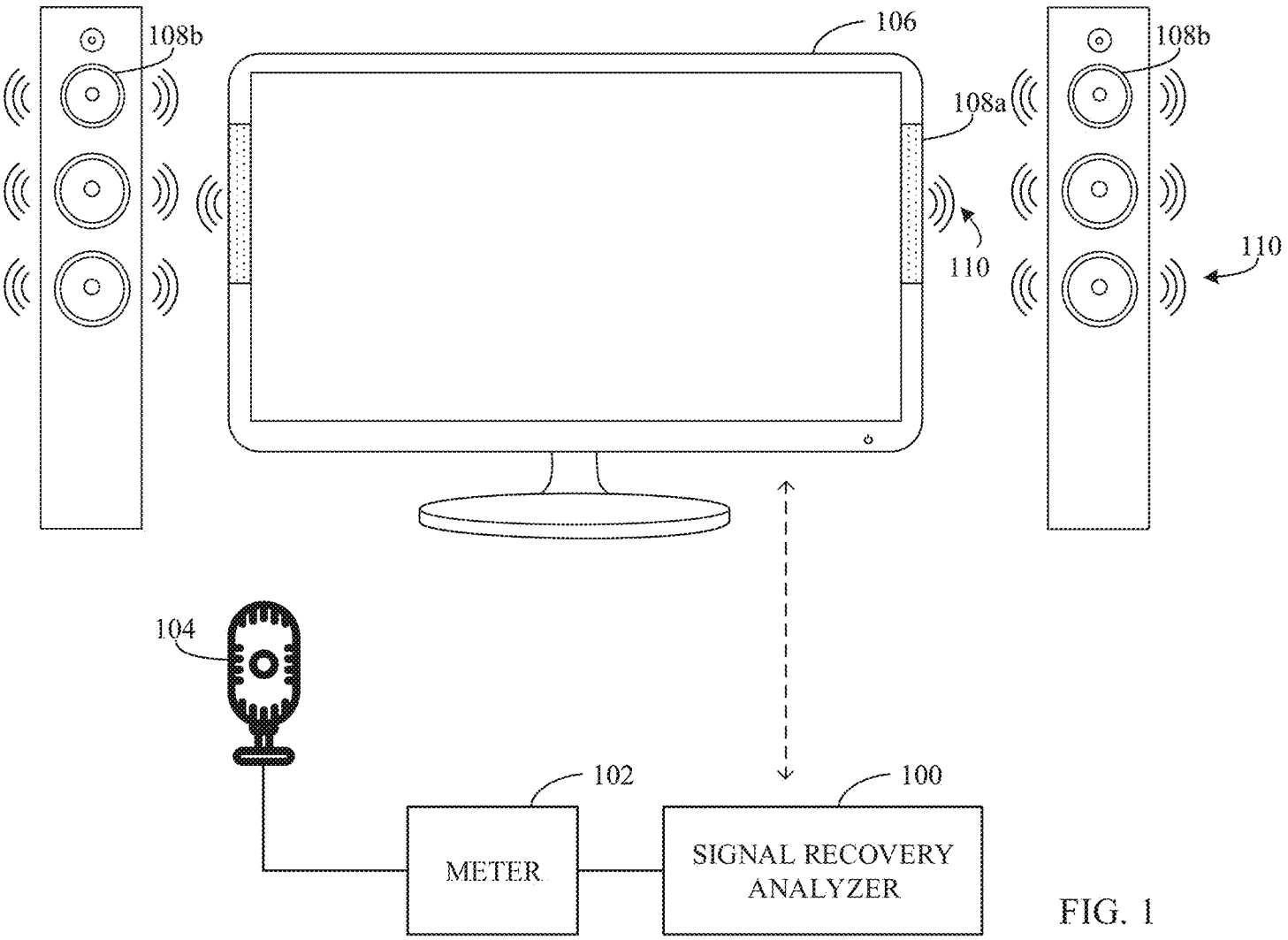
FIG. 1 is an illustration of an example signal recovery analyzer for analyzing placement of an example microphone for watermark and/or signature recovery.

When a panelist signs up to have their exposure to media monitored by an audience measurement entity, the audience measurement entity sends a technician to the home of the panelist to install a meter (e.g., a media monitor) capable of gathering media exposure data from a media output device(s) (e.g., a television, a radio, a computer, etc.). Generally, the meter includes or is otherwise connected to a microphone and/or a magnetic-coupling device to gather ambient audio. In this manner, when the media output device is "on," the microphone may receive an acoustic signal transmitted by the media output device. As further described below, the meter may extract audio watermarks from the acoustic signal to identify the media. Additionally or alternatively, the meter may generate signatures and/or fingerprints based on the media. The meter transmits data related to the watermarks and/or signatures to the audience measurement entity to monitor media exposure. Examples disclosed herein relate to determining the satisfactory placement of a meter and/microphone to obtain a satisfactory signal recovery (e.g., watermark and/or signature recovery rate).

Audio watermarking is a technique used to identify media such as television broadcasts, radio broadcasts, advertisements (television and/or radio), downloaded media, streaming media, prepackaged media, etc. Existing audio watermarking techniques identify media by embedding one or more audio codes (e.g., one or more watermarks), such as media identifying information and/or an identifier that may be mapped to media identifying information, into an audio and/or video component. In some examples, the audio or video component is selected to have a signal characteristic sufficient to mask the watermark. As used herein, the terms "code" or "watermark" are used interchangeably and are defined to mean any identification information (e.g., an identifier) that may be inserted or embedded in the audio or video of media (e.g., a program or advertisement) for the purpose of identifying the media or for another purpose such as tuning (e.g., a packet identifying header). As used herein "media" refers to audio and/or visual (still or moving) content and/or advertisements. To identify watermarked media, the watermark(s) are extracted and used to access a table of reference watermarks that are mapped to media identifying information.

Unlike media monitoring techniques based on codes and/or watermarks included with and/or embedded in the monitored media, signature or fingerprint-based media monitoring techniques generally use one or more inherent characteristics of the monitored media during a monitoring time interval to generate a substantially unique proxy for the media. Such a proxy is referred to as a signature or fingerprint, and can take any form (e.g., a series of digital values, a waveform, etc.) representative of any aspect(s) of the media signal(s) (e.g., the audio and/or video signals forming the media presentation being monitored). A signature may be a series of signatures collected in series over a time interval. A good signature is repeatable when processing the same media presentation, but is unique relative to other (e.g., different) presentations of other (e.g., different) media. Accordingly, the term "signature" and "fingerprint" are used interchangeably herein and are defined herein to mean a proxy for identifying media that is generated from one or more inherent characteristics of the media.

Signature-based media monitoring generally involves determining (e.g., generating and/or collecting) signature(s) representative of a media signal (e.g., an audio signal and/or a video signal) output by a monitored media device and comparing the monitored signature(s) to one or more references signatures corresponding to known (e.g., reference) media sources. Various comparison criteria, such as a cross-correlation value, a Hamming distance, etc., can be evaluated to determine whether a monitored signature matches a particular reference signature. When a match between the monitored signature and one of the reference signatures is found, the monitored media can be identified as corresponding to the particular reference media represented by the reference signature that matched the monitored signature. Because attributes, such as an identifier of the media, a presentation time, a broadcast channel, etc., are collected for the reference signature, these attributes may then be associated with the monitored media whose monitored signature matched the reference signature. Example systems for identifying media based on codes and/or signatures are long known and were first disclosed in Thomas, U.S. Pat. No. 5,481,294, which is hereby incorporated by reference in its entirety.

Traditional meter placement techniques include placing a meter at a first location and playing media through a media output device (e.g., a television, a radio, etc.). If the meter extracts a watermark from the media after a threshold duration of time, then the location is deemed acceptable (e.g., valid). If the meter does not extract a watermark from the media after a threshold duration of time, then the location is deemed unacceptable (e.g., invalid) and the technician moves the meter to a second location and repeats the test. Such traditional techniques are time consuming, because each location requires testing for at least the threshold duration of time (e.g., 2 minutes) to determine whether the meter extracts a watermark. Additionally, traditional techniques may select a location that is capable of extracting a watermark associated with certain frequency bands (e.g., used by a first television/radio station), but the location may be incapable of extracting watermarks at other frequency bands (e.g., used by a different second television/radio station). Thus, even though the location is deemed acceptable for some watermarks, the watermark recovery rate at the location may be very low for other watermarks. Additionally, there is no test for meter placement corresponding to an acceptable location for signatures, because generated signatures need to be compared to an off-site database to determine if the obtained signatures were properly generated. Examples disclosed herein alleviate such problems associated with traditional meter placement techniques by determining signal recovery rates for watermarks and signatures across the audio frequency spectrum. Examples disclosed herein provide a substantially real-time signal recovery status allowing a technician to instantly determine if a location is valid for watermark and/or signature recovery across the audio frequency spectrum without waiting for the meter to extract a watermark from media and/or without the meter transmitting a generated signature to an off-site database for validation.

Examples disclosed herein include determining signal recovery rates by analyzing a noise burst, or white noise burst, from speakers of a media output device (e.g., a television, radio, etc.) and/or speakers coupled or otherwise connected to the media output device. As used herein, a white noise burst is an audio signal that includes energy that is approximately equally distributed throughout all of the audio frequency spectrum. Examples disclosed herein include placing a microphone at a first location to receive the white noise burst. When the white noise burst is received, the audio signal is converted into an electrical signal and sampled to generate a digital representation of the white noise burst. Examples disclosed herein determine the frequency spectrum of the white noise burst by transforming the digital representation into the frequency domain using a Fourier transform. The frequency spectrum is then applied to an absolute value function and bandpass filtered to determine the frequency bands of the detected white noise burst. Once the frequency bands are determined, examples disclosed herein compute the variance of a magnitude spectrum of one or more frequency bands (e.g., corresponding to the magnitude of the frequency spectrum at the at the one or more frequency bands) and map the variances to signal recovery rates. When the signal recovery rates and/or variances satisfy acceptable threshold(s), examples disclosed herein determine that the location as valid. When the signal recovery rates and/or variances do not satisfy the acceptable threshold(s), examples disclosed herein determine that the location as invalid. Examples disclosed herein alert the user to the signal recovery status at the current microphone location.

Examples disclosed herein include an example apparatus to analyze microphone placement for watermarks and signatures. The example apparatus comprises a signal transformer to determine a frequency spectrum of a received noise burst. The example apparatus further comprises a variance determiner to compute a variance of a magnitude spectrum of a frequency band in the frequency spectrum. The example apparatus further comprises a detection rates determiner to determine a recovery rate of at least one of a watermark or a signature based on the computed variance.

FIG. 1 illustrates an example signal recovery analyzer 100 for analyzing placement of an example meter 102 for watermark and/or signature recovery. FIG. 1 includes the example signal recovery analyzer 100, the example meter 102, an example microphone 104, an example media output device 106, example speakers 108*a*, 108*b*, and an example white noise burst 110.

The example signal recovery analyzer 100 receives digital signals representative of digital samples of an audio signal (e.g., the example white noise burst 110) received by the example microphone 104 (e.g., after being sampled by an analog to digital converter in the example microphone 104 and/or the example meter 102) from the example meter 102. The example signal recovery analyzer 100 (1) transforms the digital samples of the received digital signal into the frequency domain (e.g., spectrum) (e.g., to generate frequency samples) using a Fourier Transform, (2) calculates the absolute value of the frequency samples, (3) bandpass filters the frequency samples to separate the frequency samples into frequency bands, (4) computes the variance of a magnitude spectrum of one or more of the frequency bands, (5) maps the variances to watermark/signature detection rates (e.g., greater the variance, worse the detection rate), and (6) outputs the results to a user/technician. In some examples, the example signal recovery analyzer 100 may interface with the example media output device 106 (e.g., via a wired or wireless connection) to instruct the example media output device 106 to output the white noise burst(s) 110. The example signal recovery analyzer 100 is further described in conjunction with FIG. 2.

The example meter 102 is a device installed in a location of a panelist that monitors exposure to media from the example media output device 106. Panelists are users included in panels maintained by a ratings entity (e.g., an audience measurement company) that owns and/or operates the ratings entity subsystem. The example meter 102 may extract watermarks and/or generate signatures from media output by the example media output device 106 to identify the media. The example meter 102 is coupled or otherwise connected to the example microphone 104. The example microphone 104 is device that receives ambient audio. Alternatively, the example microphone 104 may be magnetic-coupling device (e.g., an induction coupling device, a loop coupling receiver, a telecoil receiver, etc.), and/or any device capable of receiving an audio signal. In such examples, the magnetic-coupling device may receive an audio signal (e.g., the example white noise burst 110) wirelessly rather than acoustically. The example microphone 104, the example meter 102, and the example signal recovery analyzer 100 may be connected via a wired or wireless connection. In some examples, the example microphone 104, the example meter 102, and/or the example signal recovery analyzer 100 may be one device. For example, the example microphone 104 and/or the example signal recovery analyzer 100 may be embedded in the example meter 102.

The example media output device 106 is a device that outputs media. Although the example media output device 106 of FIG. 1 is illustrated as a television, the example media output device may be a radio, an MP3 player, a video game counsel, a stereo system, a mobile device, a computing device, a tablet, a laptop, a projector, a DVD player, a set-top-box, an over-the-top device, and/or any device capable of outputting media. The example media output device may include speakers 108*a* and/or may be coupled, or otherwise connected to portable speakers 108*b* via a wired or wireless connection. The example speakers 108*a*, 108*b* output the audio portion of the media output by the example media output device.

In operation, the example microphone 104 and/or meter 102 is placed in a location for testing the watermark and/or signature recovery rate of the location. Once located, the example speakers 108*a* and/or 108*b* output the example white noise burst 110. As described above, the example white noise burst 110 is an audio signal that includes energy that is approximately equally distributed throughout all of the frequency spectrum. In some examples, a user may instruct the media output device 106 to output the white noise burst 110 via the example speakers 108*a* and/or 108*b*. In some examples, the signal recovery analyzer 100 may interface with the example media output device 106 to output the white noise burst 110.

The example microphone 104 receives the example white noise burst 110. The microphone 104 converts the example white noise burst 110 (e.g., an audio signal) into an electrical signal representative of the audio signal. The example microphone 104 transmits the electrical signal to the example meter 102. The example meter 102 converts the electrical signal into a digital signal. In some examples, the meter 102 includes an analog to digital converter to sample or otherwise convert the electric signal into the digital signal. The meter 102 transmits the digital signal to the example signal recovery analyzer 100.

The example signal recovery analyzer 100 (1) transforms the digital samples of the received digital signal into the frequency domain (e.g., to generate frequency samples) using a Fourier Transform, (2) calculates the absolute value of the frequency samples, (3) bandpass filters the frequency samples to separate the frequency samples into frequency bands, (4) computes the variance of a magnitude spectrum of one of more of the frequency bands, (5) maps the variances to watermark/signature detection rates (e.g., greater the variance, worse the detection rate), and (6) outputs the results to a user/technician. In this manner, the example signal recovery analyzer 100 computes a real-time watermark and/or signature recovery rate across multiple frequency bands at the first location. As the example microphone 104 and/or the example meter 102 is moved, the example microphone 104 continues to receive the example white noise burst 110 and the example signal recovery analyzer 100 continues to monitor the watermark and/or signature recovery status until a satisfactory location is found. A satisfactory location is a location associated where all of the detection rates satisfy a threshold(s).

Figure 2:
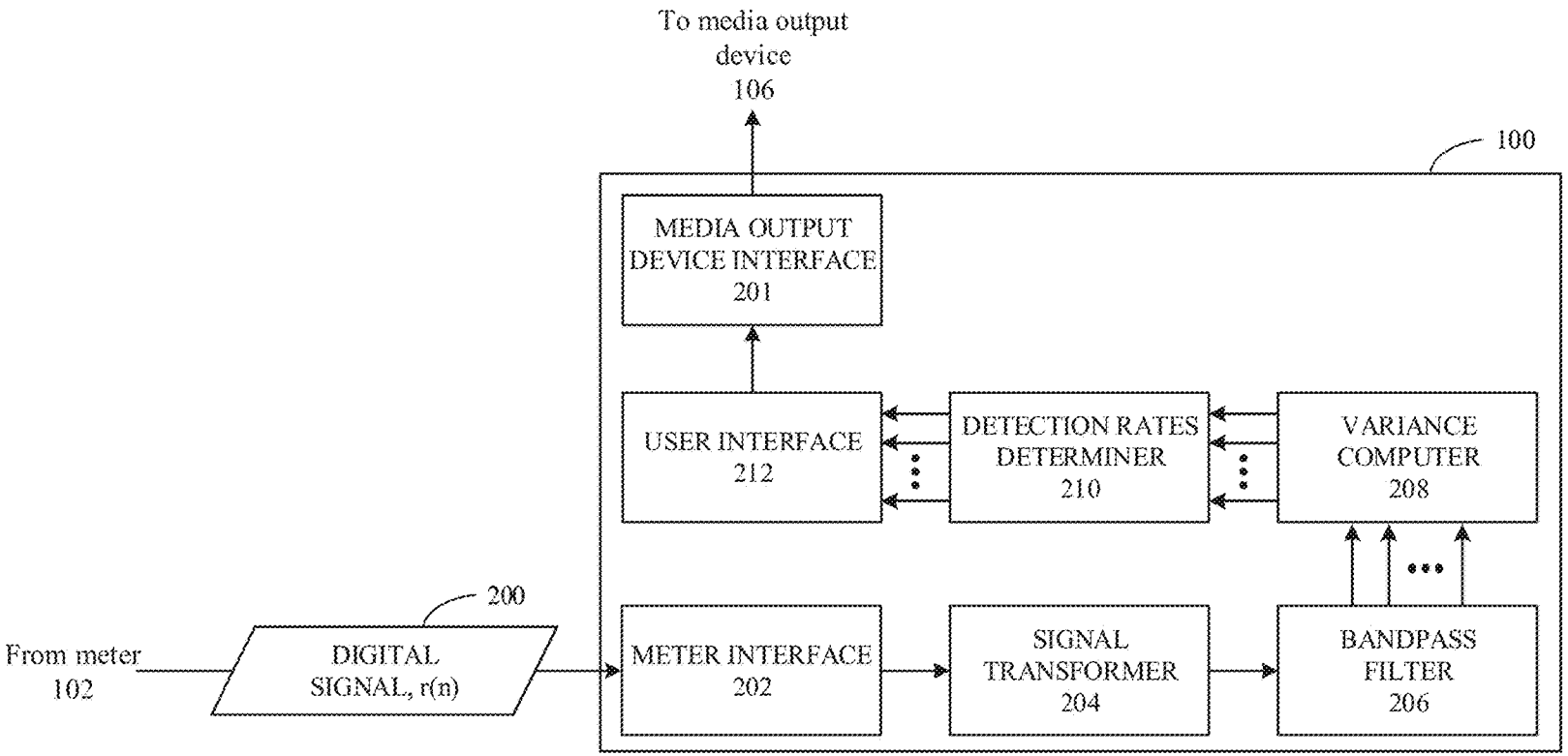
FIG. 2 is a block diagram of the example signal recovery analyzer of FIG. 1.

FIG. 2 is a block diagram of an example implementation of the example signal recovery analyzer 100 of FIG. 1, disclosed herein, to analyze placement of the example meter 102 of FIG. 1 for watermark and/or signature recovery. While the example signal recovery analyzer 100 is described in conjunction with the example meter 102 and media output device 106 of FIG. 1, the example signal recovery analyzer 100 may be utilized to analyze placement of any type of meter recovering watermarks and/or signatures from any type of media device. The example signal recovery analyzer 100 receives an example digital signal, r(n), 200 from the example meter 102 of FIG. 2. The example signal recovery analyzer 100 includes an example media output device interface 201, an example meter interface 202, an example signal transformer 204, an example bandpass filter 206, an example variance determiner 208, an example detection rates determiner 210, and an example user interface 212.

The example media output device interface 201 interfaces with the example media output device 106 of FIG. 1 to output the example white noise burst(s) 110 (FIG. 1). For example, when a signal detection test occurs, the example media output device interface 201 may transmit instructions to the example media output device 106 (e.g., via a wired or wireless communication) to output the white noise burst(s) 110 using the example speakers 108*a, b*. The instructions may be transmitted via a wired or wireless connection. In some examples, the media output device interface 201 may not be included. In such examples, a technician may have to manually instruct the media output device 106 to output the example white noise burst(s) 110.

The example meter interface 202 interfaces with the example meter 102 to receive the example digital signal 200. As described above in conjunction with FIG. 1, the example digital signal 200 is a signal representative of the example white noise 110 received by the example microphone 104 of FIG. 1. The example meter interface 202 transmits the example digital signal 200 to the example signal transformer 204.

The example signal transformer 204 receives the digital signal 200 and transforms the digital signal 200 into the frequency domain, generating a frequency-domain signal (e.g., Fourier-domain signal, frequency spectrum, etc.), R(f). For example, the example signal transformer 204 may perform a Fourier Transform on the example digital signal 200 to generate the frequency-domain signal. The frequency-domain signal represents the frequency spectrum of the white noise burst 110 received by the example microphone 104 of FIG. 1. Additionally, the example signal transformer 204 computes an absolute value of the frequency-domain signal to generate the frequency response of the example white noise burst 110 (e.g., |R(f)|). The example signal transformer 204 transmits the frequency response (e.g., $|R(f)|$) to the example bandpass filter 206.

The example bandpass filter 206 filters the frequency response to separate the frequency response into its different frequency bands, $|R_1(f)|$, $|R_2(f)|$, . . . $|R_N(f)|$. Alternatively, the example bandpass filter 206 may analyze the frequency response within different frequency bands to identify the frequency bands. In some examples, the bandpass filter 206 may discard any frequency bands that are not relevant (e.g., frequency bands that are not used for watermarking and/or signaturing). In some examples, the bandpass filter 206 includes multiple bandpass filter circuits capable of filtering a signal into different frequency bands. In such examples, the frequency response is input into the one or more bandpass filters to generate the multiple frequency bands. The example bandpass filter 206 transmits the frequency bands to the example variance determiner 208.

The example variance determiner 208 computes the variance of a magnitude spectrum of one or more of the example frequency bands, $V_1$, $V_2$, . . . $V_N$. The example variance determiner 208 computes the variance of a magnitude spectrum of a frequency band of interest using the following formula:

$$V(\Delta f) = \frac{1}{n}\sum_{k=i}^{i+n-1}(|X_k| - \mu)^2 \quad \text{(Equation 1)}$$

Where $\Delta f$ is the frequency band of interest, n is the number of frequency bins within the band of interest, i is the index of the first bin in the band of interest, $|X_k|$ is the magnitude of the Fourier transform at the $k^{th}$ frequency bin, and $\mu$ is the mean of the frequency band of interest. The mean is calculated using the following formula:

$$\mu = \frac{1}{n}\sum_{k=i}^{i+n-1}|X_k| \quad \text{(Equation 2)}$$

As described above, the lower the variance, the higher the chance of recovering a watermark and/or signature from the audio. The example variance determiner 208 transmits the variances to the example detection rates determiner 210.

The example detection rates determiner 210 maps one or more of the variances, $V_1$, $V_2$, . . . , $V_N$, to a detection rate. Because the variance of different frequency bands may correlate to different detection rates, the example detection rates determiner 210 generate one or more variance-to-detection rate mapping based on the particular characteristics of the frequency band. For example, small variance in higher frequency bands may correspond to worse detection rates than the same small variance in lower frequency bands. In such an examples, the variance in the high frequency bands may correspond to different detection rates than the variance in the low frequency bands. Additionally, the example detection rates determiner 210 compares one or more of the detection rates to detection rate thresholds to determine which frequency bands correspond to satisfactory detection rates. Additionally, or alternatively, the example detection rates determiner 210 may compare one or more of the variances to variance rate thresholds to determine which frequency bands correspond to satisfactory detection rates. The example detection rates determiner 210 determines whether the location of the example microphone 104 is a valid based on the comparison. For example, if the threshold detection rate is 93% for all frequency bands and one or more of the frequency bands corresponds to a detection rate of 93% or better, the example detection rates determiner 210 determines that the location is valid. In such an example, if one of the frequency bands corresponds to a detection rate of 90%, the example detection rates determiner 210 flags the frequency band and may determine that the location is not valid. In some examples, such as when some certain frequency bands are not frequency bands of interest (e.g., watermarks or signatures do not correspond to the certain frequency bands), the example detection rates determiner 210 may flag the certain frequency bands, but still may determine that the location is valid. In some examples, the detection rate determiner 210 may determine that a location is valid for watermarks within certain frequency bands, but not valid for signatures. The example detection rates determiner 210 transmits the variances, the detection rates, the flags, and/or any other data related to signal detection to the example user interface 212.

The example user interface 212 interfaces with a user (e.g., a technician installing the example meter 102 of FIG. 1) to display the real-time status of the current location of the example microphone 104 of FIG. 1. The example user interface 212 may display the variances, the detection rates, the flags, and/or any other data related to signal detection via a graphical interface. The example user interface 212 identifies based on the signal detection data (e.g., the variance and/or the detection rates), that the current location of the example microphone 104 is a valid location or not. Additionally, the example user interface 212 may receive settings data from the example user and adjust the location status based on the settings data. For example, the user may adjust the settings data to adjust thresholds, determine frequency bands of interest (e.g., which frequency bands to monitor and which frequency bands to discard), and/or adjust the display of the location status (e.g., which data to include and which data to exclude in a graphical interface of the example user interface 212). In some examples, a user may interface with the example user interface 212 to initialize the signal detection test. In such examples, the example user interface 212 may instruct the example media output device interface 201 to transmit instructions to the example media output device 106 to output the white noise burst(s) 110 for a predetermined duration of time.

While example manners of implementing the example signal recovery analyzer 100 of FIG. 1 is illustrated in FIG. 2, elements, processes and/or devices illustrated in FIG. 2 may be combined, divided, re-arranged, omitted, eliminated and/or implemented in any other way. Further, the example media output device interface 201, the example meter interface 202, the example signal transformer 204, the example bandpass filter 206, the example variance determiner 208, the example detection rates determiner 210, the example user interface 212, and/or, more generally, the example signal recovery analyzer 100 of FIG. 2, may be implemented by hardware, machine readable instructions, software, firmware and/or any combination of hardware, machine readable instructions, software and/or firmware. Thus, for example, any of the example media output device interface 201, the example meter interface 202, the example signal transformer 204, the example bandpass filter 206, the example variance determiner 208, the example detection rates determiner 210, the example user interface 212, and/or, more generally, the example signal recovery analyzer 100 of FIG. 2 could be implemented by analog and/or digital circuit(s), logic circuit(s), programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example media output device interface 201, the example meter interface 202, the example signal transformer 204, the example bandpass filter 206, the example variance determiner 208, the example detection rates determiner 210, the example user interface 212, and/or, more generally, the example signal recovery analyzer 100 of FIG. 2 is/are hereby expressly defined to include a tangible computer readable storage device or storage disk such as a memory, a digital versatile disk (DVD), a compact disk (CD), a Blu-ray disk, etc. storing the software and/or firmware. Further still, the example signal recovery analyzer 100 of FIG. 2 includes elements, processes and/or devices in addition to, or instead of, those illustrated in FIG. 3, and/or may include more than one of any or all of the illustrated elements, processes and devices.

Figure 3:
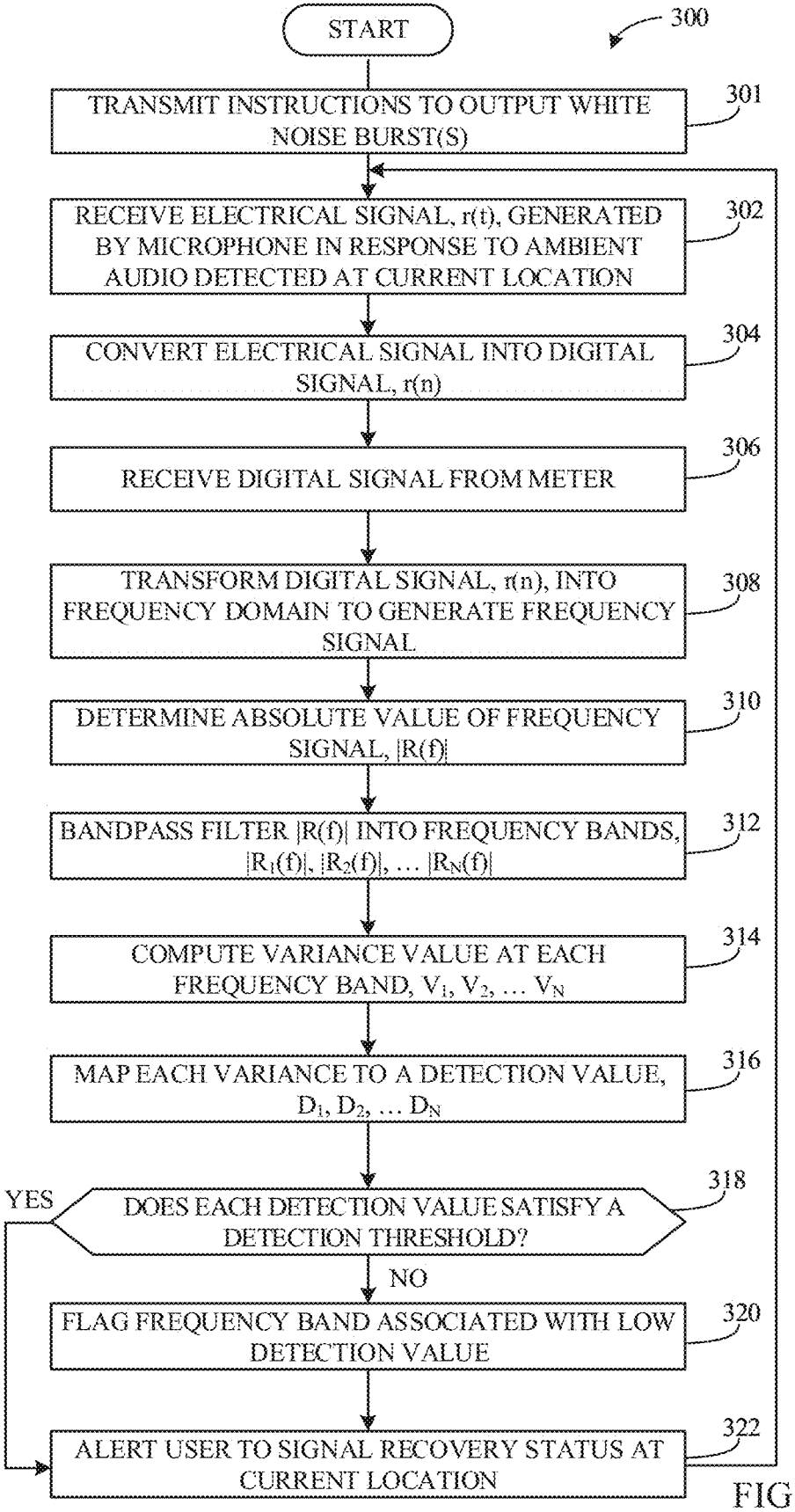
FIG. 3 is a flowchart representative of example machine readable instructions that may be executed to implement the example signal recovery analyzer of FIGS. 1 and 2 to analyze placement of the example microphone of FIG. 1.

A flowchart representative of example machine readable instructions for implementing the example signal recovery analyzer 100 of FIG. 1 is shown in FIG. 3. In the examples, the machine readable instructions comprise a program for execution by a processor such as the processor 412 shown in the example processor platform 400 discussed below in connection with FIG. 4. The program may be embodied in machine readable instructions stored on a tangible computer readable storage medium such as a CD-ROM, a floppy disk, a hard drive, a digital versatile disk (DVD), a Blu-ray disk, or a memory associated with the processor 412, but the entire program and/or parts thereof could alternatively be executed by a device other than the processor 412 and/or embodied in firmware or dedicated hardware. Further, although the example program is described with reference to the flowchart illustrated in FIG. 3, many other methods of implementing the example signal recovery analyzer 100 of FIGS. 1 and 2 may alternatively be used. For example, the order of execution of the blocks may be changed, and/or some of the blocks described may be changed, eliminated, or combined.

As mentioned above, the example process of FIG. 3 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example process of FIG. 3 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

FIG. 3 is an example flowchart 300 representative of example machine readable instructions that may be executed by the example signal recovery analyzer 100 of FIGS. 1 and 2 to provide real-time signal recovery status for a location of the example microphone 104 of FIG. 1. Although the instructions of FIG. 7 are described in conjunction with the example meter 102, microphone 104, media output device 106, and signal recovery analyzer 100 of FIGS. 1 and 2, the example instructions may be utilized by any type of meter, microphone, media output device, and/or signal recovery analyzer.

At block 301, the example media output device interface 201 transmits instructions (e.g., via a wired or wireless communication) to the example media output device 106 to output one or more white noise bursts 110. As described above, the example white noise burst 110 is an audio signal that includes energy that is approximately equally distributed throughout all of the frequency spectrum. In response to the transmitted instructions, the example media output device 106 will output the one or more white noise bursts 110 via the example speakers 108*a* and/or 108*b*. Alternatively, in examples where the example media output device interface 201 is not included in the example signal recovery analyzer 100, a technician may control the example media output device 106 to output the one or more white noise bursts 110.

At block 302, the example meter 102 receives an electrical signal, r(t), generated by the example microphone 104 in response to the detected ambient audio at the current location (e.g., a first location). The electrical signal is representative of ambient audio captured by the example microphone 104. The ambient audio includes the example white noise burst 110. At block 304, the example meter 102, converts the received electrical signal (r(t)) into the example digital signal (r(n)) 200. The example meter 102 may include an analog to digital converter to sample the electrical signal generating the digital signal 200. At block 306, the example meter interface 202 receives the example digital signal 200 from the example meter 102. As described above, the example signal recovery analyzer 100 and the example meter 102 may be combined into one device.

At block 308, the example signal transformer 204 transforms the example digital signal 200 into the frequency domain to generate a frequency-domain signal (R(f)). As described above in conjunction with FIG. 2, the example signal transformer 204 transforms the example digital signal 200 by applying a Fourier transform to the example digital signal 200. At block 310, the example signal transformer 204 applies an absolute value function to the frequency-domain signal (|R(f)|).

At block 312, the example bandpass filter 206 bandpass filters the absolute value of the frequency-domain signal (|R(f)|) into various frequency bands ($|R_1(f)|$, $|R_2(f)|$, . . . $|R_N(f)|$). In some examples, the bandpass filter 206 may discard any frequency bands that are not of interest based on settings data set by a user via the example user interface 212. At block 314, the example variance determiner 208 computes a variance value at the one or more frequency bands. As described above, the variance of a magnitude spectrum of a frequency band corresponds to the likelihood that a watermark encoded in the frequency band and/or a generated signature corresponding to a frequency band will be recovered by the example meter 102 (e.g., the lower the variance, the better the recovery rate).

At block 316, the example detection rates determiner 210 maps one or more variances to one or more detection rates. As described above, the mapping of a variance to a detection value may be different for each frequency band. For example, a variance value at a first frequency band may map to a detection rate of 85%; however, the variance value at a second frequency band may map to a detection rate of 94%. The mapping settings may be based on user and/or meter manufacture preferences. At block 318, the example detection rates determiner 210 determines if one or more detection value satisfies a detection threshold. Alternatively, multiple detection thresholds may be used. For example, detection thresholds at lower frequency bands may be different than the detection value thresholds at higher frequency bands.

If the example detection rates determiner 210 determines that one or more of the detection values do not satisfy a detection threshold, the example detection rates determiner 210 flags the frequency band associated with the low detection value (e.g., the frequency band whose detection value does not satisfy the detection threshold for that frequency band) (block 320). Additionally or alternatively, the detection rates determiner 210 may flag frequency bands based on a variance threshold. In such examples, the detection rates determiner 210 may compare the variances at the different frequency bands to a variance threshold.

At block 322, the example user interface 212 alerts users to the signal recovery status of the example microphone 104 at the current location. The alert may include a simple status (e.g., a valid location indicator when all of the detection thresholds are satisfied and an invalid location indicator when one or more of the detection thresholds are not satisfied) or an advance status displaying the variances of the one or more frequency bands, the detection rates of the one or more frequency bands, the flags and data related to the flags, data related to the thresholds, and/or data related to which frequency bands meet and do not meet the thresholds. After block 322, the process repeats providing a real-time status update relating to the recovery status of the microphone 104 at a location. In this manner, a technician can move the example microphone 104 to various locations, while receiving instant feedback, to identify a valid and/or satisfactory location for the example microphone 104.

Figure 4:
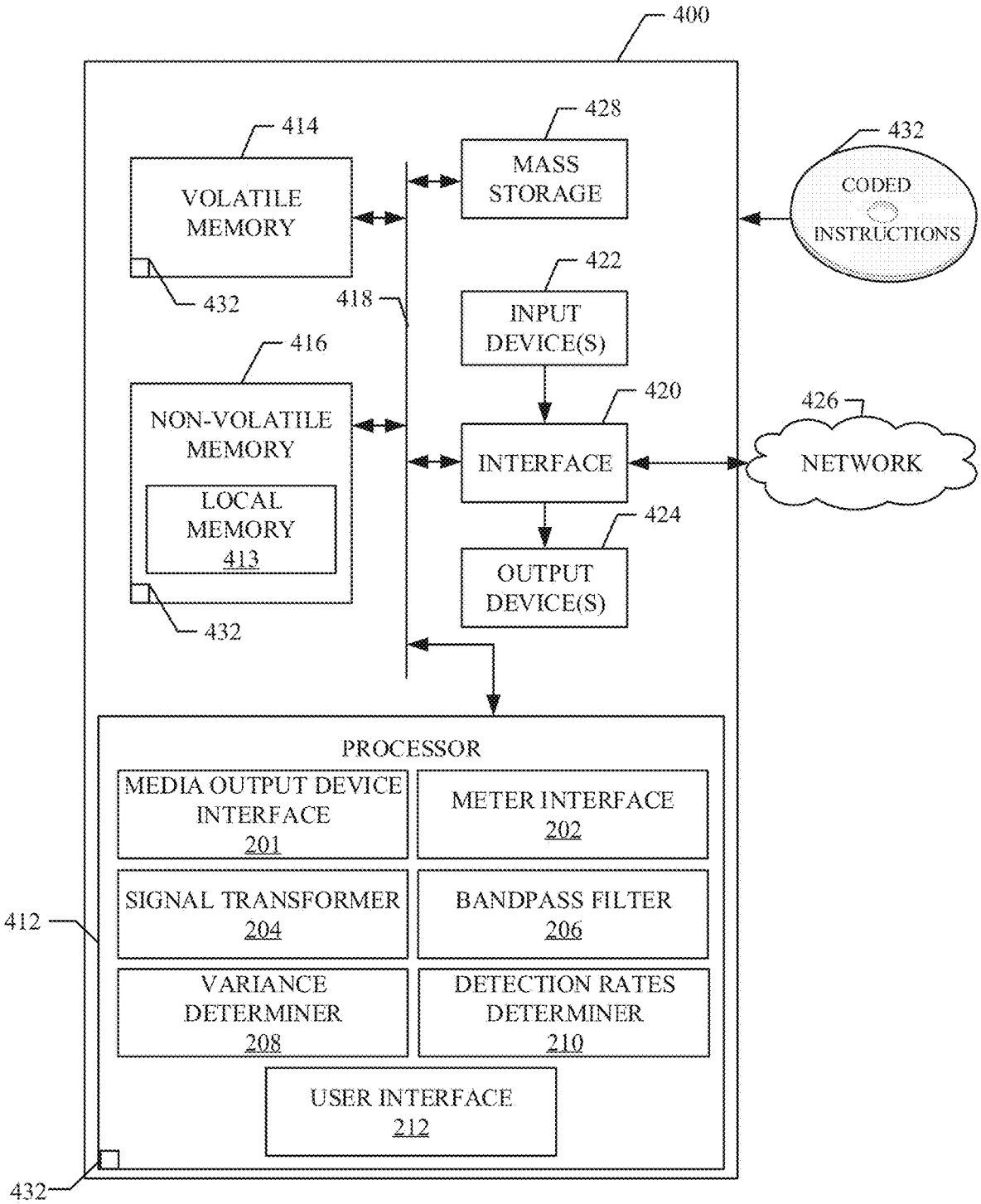
FIG. 4 is a block diagram of a processor platform structured to execute the example machine readable instructions of FIG. 3 to control the example signal recovery analyzer of FIGS. 1 and 2.

FIG. 4 is a block diagram of an example processor platform 400 capable of executing the instructions of FIG. 3 to implement the example signal recovery analyzer 100 of FIGS. 1 and 2. The processor platform 400 can be, for example, a server, a personal computer, a mobile device (e.g., a cell phone, a smart phone, a tablet such as an iPad™), a personal digital assistant (PDA), an Internet appliance, or any other type of computing device.

The processor platform 400 of the illustrated example includes a processor 412. The processor 412 of the illustrated example is hardware. For example, the processor 412 can be implemented by integrated circuits, logic circuits, microprocessors or controllers from any desired family or manufacturer.

The processor 412 of the illustrated example includes a local memory 413 (e.g., a cache). The example processor 412 of FIG. 4 executes the instructions of FIG. 3 to implement the example media output device interface 201, the example meter interface 202, the example signal transformer 204, the example bandpass filter 206, the example variance determiner 208, the example detection rates determiner 210, and/or the example user interface 212 of FIG. 2 to implement the example signal recovery analyzer 100. The processor 412 of the illustrated example is in communication with a main memory including a volatile memory 414 and a non-volatile memory 416 via a bus 418. The volatile memory 414 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 416 may be implemented by flash memory and/or any other desired type of memory device. Access to the main memory 414, 416 is controlled by a clock controller.

The processor platform 400 of the illustrated example also includes an interface circuit 420. The interface circuit 420 may be implemented by any type of interface standard, such as an Ethernet interface, a universal serial bus (USB), and/or a PCI express interface.

In the illustrated example, one or more input devices 422 are connected to the interface circuit 420. The input device(s) 422 permit(s) a user to enter data and commands into the processor 412. The input device(s) can be implemented by, for example, a sensor, a microphone, a camera (still or video), a keyboard, a button, a mouse, a touchscreen, a track-pad, a trackball, isopoint and/or a voice recognition system.

One or more output devices 424 are also connected to the interface circuit 420 of the illustrated example. The output devices 424 can be implemented, for example, by display devices (e.g., a light emitting diode (LED), an organic light emitting diode (OLED), a liquid crystal display, a cathode ray tube display (CRT), a touchscreen, a tactile output device, and/or speakers). The interface circuit 420 of the illustrated example, thus, typically includes a graphics driver card, a graphics driver chip or a graphics driver processor.

The interface circuit 420 of the illustrated example also includes a communication device such as a transmitter, a receiver, a transceiver, a modem and/or network interface card to facilitate exchange of data with external machines (e.g., computing devices of any kind) via a network 426 (e.g., an Ethernet connection, a digital subscriber line (DSL), a telephone line, coaxial cable, a cellular telephone system, etc.).

The processor platform 400 of the illustrated example also includes one or more mass storage devices 428 for storing software and/or data. Examples of such mass storage devices 428 include floppy disk drives, hard drive disks, compact disk drives, Blu-ray disk drives, RAID systems, and digital versatile disk (DVD) drives.

The coded instructions 432 of FIG. 3 may be stored in the mass storage device 428, in the volatile memory 414, in the non-volatile memory 416, and/or on a removable tangible computer readable storage medium such as a CD or DVD.

From the foregoing, it would be appreciated that the above disclosed method, apparatus, and articles of manufacture analyze meter/microphone placement for watermark and signature recovery. Examples disclosed herein determine watermark and/or signature recovery rates at a particular location based on analyzing the frequency spectrum of a white noise burst received by a microphone of a meter at the location. Examples disclosed herein (1) generate digital samples of a white noise burst output by a media output device, (2) transform the digital samples of the received digital signal into the frequency domain (e.g., spectrum) (e.g., to generate frequency samples) using a Fourier Transform, (3) calculate the absolute value of the frequency samples, (4) bandpass filter the frequency samples to separate the frequency samples into frequency bands, (5) compute the variance of a magnitude spectrum of the one or more of the frequency bands, (6) map the variances to watermark/signature detection rates (e.g., greater the variance, worse the detection rate), and (7) output the results to a user/technician in real time. Some examples disclosed herein further include transmitting instructions to a media output device to output the white noise signal.

Traditional techniques meter/microphone placement include placing the meter/microphone in a first location and outputting media on a media output device until a threshold amount of time has passed (e.g., 2 minutes). If a watermark was not extracted from the media, the technician determines that the location is invalid and moves the meter/microphone to additional locations for the 2-minute test until a watermark is extracted. However, such traditional techniques are time consuming and only provide feedback based on one watermark in one frequency band. Additionally, in order to determine if a signature generated by a meter is valid, traditional techniques require the generated signature to be transmitted to an off-site server to be compared to a database of signatures. Accordingly, such traditional techniques are not set up to determine signature recovery rates. Examples disclosed herein alleviate problems associated with such traditional techniques by analyzing white noise bursts across a frequency spectrum in real time. In this manner, a technician can instantly identify the validity of a meter/microphone placement location in every relevant frequency band, thereby providing watermark and/or signature recovery rates for any watermark and/or signature corresponding to any relevant frequency band.

Although certain example methods, apparatus and articles of manufacture have been described herein, other implementations are possible. The scope of coverage of this patent is not limited thereto. On the contrary, this patent covers all methods, apparatus and articles of manufacture fairly falling within the scope of the claims of this patent.

What is claimed is:

1. A non-transitory computer readable storage medium comprising instructions which, when executed, cause one or more processors to at least:

determine a variance of a magnitude spectrum of a frequency band corresponding to a frequency spectrum of a first audio signal sensed with an audio sensor;

determine, based on the variance, a recovery rate associated with at least one of watermark detection or signature generation to be performed on a second audio signal to be sensed with the audio sensor; and output a visual indication of a status of the audio sensor, the status based on the recovery rate.

2. The non-transitory computer readable storage medium of claim 1, wherein the instructions cause the one or more processors to map the variance to a detection rate corresponding to at least one of watermark detections or signature matches corresponding to the frequency band.

3. The non-transitory computer readable storage medium of claim 2, wherein the instructions cause the one or more processors to determine the recovery rate based on the map.

4. The non-transitory computer readable storage medium of claim 1, wherein the instructions cause the one or more processors to determine the status of the audio sensor based on comparison of the recovery rate to a threshold.

5. The non-transitory computer readable storage medium of claim 4, wherein the instructions cause the one or more processors to cause a user interface to indicate that a location of the audio sensor is valid when the recovery rate satisfies the threshold.

6. The non-transitory computer readable storage medium of claim 1, wherein the audio sensor is associated with a meter, the first audio signal corresponds to noise burst sensed by the audio sensor, and the recovery rate corresponds to a position of the meter.

7. The non-transitory computer readable storage medium of claim 6, wherein the noise burst is output by at least one of a media output device or a speaker associated with the media output device.

8. The non-transitory computer readable storage medium of claim 7, wherein the instructions cause the one or more processors to transmit instructions to cause the at least one of the media output device or the speaker to output the noise burst.

9. An apparatus comprising:

means for determining a variance of a magnitude spectrum of a frequency band corresponding to a frequency spectrum of a first audio signal sensed with an audio sensor; and means for determining a recovery rate associated with at least one of watermark detection or signature generation to be performed on a second audio signal to be sensed with the audio sensor, the means for determining the recovery rate to determine the recovery rate based on the variance; and means for displaying an indication of a status of the audio sensor, the status based on the recovery rate.

10. The apparatus of claim 9, wherein the means for determining the recovery rate is to map the variance to a detection rate corresponding to at least one of watermark detections or signature matches corresponding to the frequency band.

11. The apparatus of claim 10, wherein the means for determining the recovery rate is to determine the recovery rate based on the map.

12. The apparatus of claim 9, wherein the means for displaying is to determine the status of the audio sensor based on comparison of the recovery rate to a threshold.

13. The apparatus of claim 12, wherein the means for displaying the indication is to indicate that a location of the audio sensor is valid when the recovery rate satisfies the threshold.

14. The apparatus of claim 9, wherein the first audio signal corresponds to a noise burst to be output by at least one of a media output device or a speaker associated with the media output device.

15. The apparatus of claim 14, further including means for transmitting instructions to cause the at least one of the media output device or the speaker to output the noise burst.

16. A method comprising:

determining, by executing an instruction with one or more processors, a variance of a magnitude spectrum of a frequency band corresponding to a frequency spectrum of a first audio signal sensed with an audio sensor;

determining, by executing an instruction with the one or more processors, a recovery rate associated with at least one of watermark detection or signature generation to be performed on a second audio signal to be sensed with the audio sensor, the recovery rate based on the variance; and indicating a validity of a location of the audio sensor based on the recovery rate.

17. The method of claim 16, further including mapping the variance to a detection rate corresponding to at least one of watermark detections or signature matches corresponding to the frequency band.

18. The method of claim 17, wherein the determining of the recovery rate is based on the mapping.

19. The method of claim 16, further including determining the validity of the location of the audio sensor by comparing the recovery rate to a threshold.

20. The method of claim 16, wherein the first audio signal corresponds to a noise burst output by at least one of a media output device or a speaker associated with the media output device, and further including transmitting one or more commands to cause the at least one of the media output device or the speaker to output the noise burst.

* * * * *